US005120155A

United States Patent [19]

Samspon

[11] Patent Number: 5,120,155

[45] Date of Patent: Jun. 9, 1992

[54] HYDRAULIC ADJUSTABLE SPREADER BOX

[75] Inventor: Darwin L. Samspon, Salina, Kans.

[73] Assignee: Grain Belt Supply Co., Inc., Salina, Kans.

[21] Appl. No.: 677,770

[22] Filed: Mar. 29, 1991

[51] Int. Cl.[5] ..... E01C 19/48

[52] U.S. Cl. ..... 404/110; 404/101

[58] Field of Search ..... 404/101, 105, 106, 108, 404/110

[56] References Cited

U.S. PATENT DOCUMENTS

| | | | |
|---|---|---|---|
| 2,953,977 | 9/1960 | Warren | 404/110 |
| 3,029,714 | 4/1962 | Creswell | 404/110 |
| 4,749,304 | 6/1988 | Craig | 404/101 |

*Primary Examiner*—William P. Neuder

*Attorney, Agent, or Firm*—Hovey, Williams, Timmons & Collins

[57] ABSTRACT

A spreader box apparatus for use with a pavement applicating machine in spreading a pavement mixture onto a surface to be paved includes a frame, and a pair of side walls connected to the frame and defining a dimension of width which corresponds to the predetermined lateral dimension of the pavement mixture to be spread by the apparatus. The apparatus includes a plurality of spreader shafts for spreading the pavement mixture within the apparatus between the side walls and the side walls include skids on which the side walls are supported for movement relative to the surface. At least once screed is provided for metering the thickness of the pavement mixture to be spread by the apparatus. The width of the apparatus may be adjusted by moving the side walls horizontally along separate symmetrical arcuate paths each extending between a first position in which each side wall is disposed at a maximum distance from the central axis and a second position in which each side wall is disposed at a minimum distance from the central axis. This variation in the width of the apparatus results in a corresponding change in the predetermined lateral dimension of the pavement mixture to be spread.

10 Claims, 3 Drawing Sheets

HYDRAULIC ADJUSTABLE SPREADER BOX

BACKGROUND OF THE INVENTION

1. Field of the Invention

The present invention relates generally to pavement applicating machines and, more particularly, to a spreader box apparatus for use with a pavement applicating machine in spreading a pavement mixture onto a surface to be paved, wherein the width of the spreader box apparatus may be adjusted on the fly to vary the width of the pavement mixture being spread by the apparatus.

2. Discussion of the Prior Art

It is known to provide a pavement applicating machine that may be either self driven or mounted on a truck trailer and which is used to spread a pavement mixture onto a surface such as a road or the like to be paved. One example of a type of surface capable of being applied by such a machine is known as the RALUMAC system, which is a chemically triggered latex modified bituminous emulsion which is mixed with selected crushed aggregates to produce a cold laid bituminous surface. The mixture of aggregate, dry cement, emulsion, water and the RALUMAC additive combine to make a relatively low energy pavement system which has high skid resistance and long life.

The known applicating machine includes a mixing apparatus in which the various components of the surface are prepared, and a spreader box apparatus into which the mixed components are delivered and spread onto the surface to be paved. The spreader box apparatus includes a frame having a hitch by which the apparatus is connected to the applicating machine. The frame extends in the longitudinal direction of the apparatus and defines a central axis. The width of the apparatus is defined by a pair of side walls each secured to the frame by a number of rigid front and rear panel sections. Typically, each side wall is connected to the frame by three front panel sections and three rear panel sections. Each of the front and rear panel sections are bolted to one another to define rigid front and rear walls that may, in turn, be bolted to the frame and side walls to secure the side walls against movement relative to the frame.

If it is desired to alter the width of the apparatus in order to vary the lateral dimension of the pavement mixture being spread, it is necessary in the known apparatus to first loosen at least some of the bolted connections between the various front and rear panel sections. Thereafter, panel sections may be removed or added to vary the width of the apparatus, and the side walls are positioned, either manually or hydraulically, so that they may be resecured to the front and rear panel sections.

Numerous drawbacks exist with the known construction. For example, because it is necessary to undo a number of bolted connections between the front and rear panel sections as well as between the side walls, a significant amount of time is required to adjust the width of the apparatus. Further, it is necessary to employ considerable amounts of manual effort in making such adjustments.

OBJECTS AND SUMMARY OF THE INVENTION

It is an object of the present invention to provide a spreader box apparatus having a variable width which permits adjustment of the lateral dimension of a pavement mixture to be spread by the apparatus, wherein the width may be changed during a paving operation and does not require any down time of the apparatus.

Another object of the invention is to provide a spreader box apparatus having a variable width which may be adjusted without manual labor so as to reduce the cost and effort required to modify the apparatus for use in laying down pavement in various widths.

In accordance with these and other objects, a spreader box apparatus constructed in accordance with the present invention includes a frame having means for permitting connection of the apparatus to a pavement applicating machine and defining a longitudinal central axis extending in a direction parallel to the intended direction of travel of the apparatus.

A pair of side walls are provided which are connected to the frame and which together define a dimension of width corresponding to a predetermined lateral dimension of the pavement mixture to be spread by the apparatus. The apparatus also includes spreading means for spreading the pavement mixture within the apparatus between the side walls, and means for supporting the side walls on the surface for longitudinal movement relative to the surface during a paving operation.

Metering means are included for metering the thickness of the pavement mixture to be spread by the apparatus, and width adjustment means permit adjustment of the width of the apparatus by allowing movement of the side walls horizontally along separate symmetrical arcuate paths each extending between a first position in which each side wall is disposed at a maximum distance from the central axis and a second position in which each side wall is disposed at a minimum distance from the central axis. This variation in the width of the apparatus results in a corresponding change in the predetermined lateral dimension of the pavement mixture to be spread.

BRIEF DESCRIPTION OF THE DRAWING FIGURES

A preferred embodiment of the invention is discussed in detail below with reference to the attached drawing figures, wherein.

DETAILED DESCRIPTION OF THE PREFERRED EMBODIMENT

Figure 1:
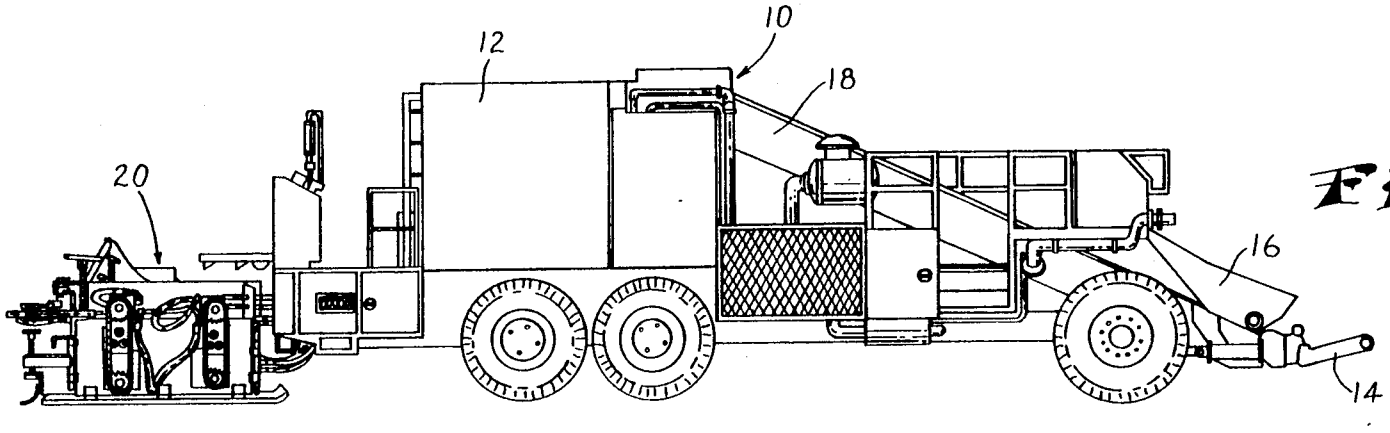
FIG. 1 is a side elevational view of a pavement applicating machine including a spreader box apparatus constructed in accordance with the preferred embodiment of the invention.

A pavement applicating machine constructed in accordance with the present invention is illustrated in FIG. 1. The machine 10 shown is self-driven, but it is understood that the machine may alternatively be mounted on a truck or tractor trailer without departing from the scope of the invention.

The machine includes a mixing apparatus 12, a front hitch 14 adapted to accommodate a nurse truck carrying mixture components, a front receiving hopper 16 into which the components are fed from the nurse truck, and a conveyor 18 extending between the hopper and the mixing apparatus for conveying the components from the hopper. A spreader box apparatus 20 is connected to the machine at the rear end thereof and is adapted to receive a pavement mixture from the mixing apparatus 12 and to spread the mixture across the width of the spreader box apparatus so that a smooth even layer of the mixture is spread onto the surface to be paved.

In an exemplary embodiment, the machine 10 may be used to apply a RALUMAC system of the type described above. However, it is understood that the spreader box apparatus 20 may find application with other types of applicating machines.

Figure 2:
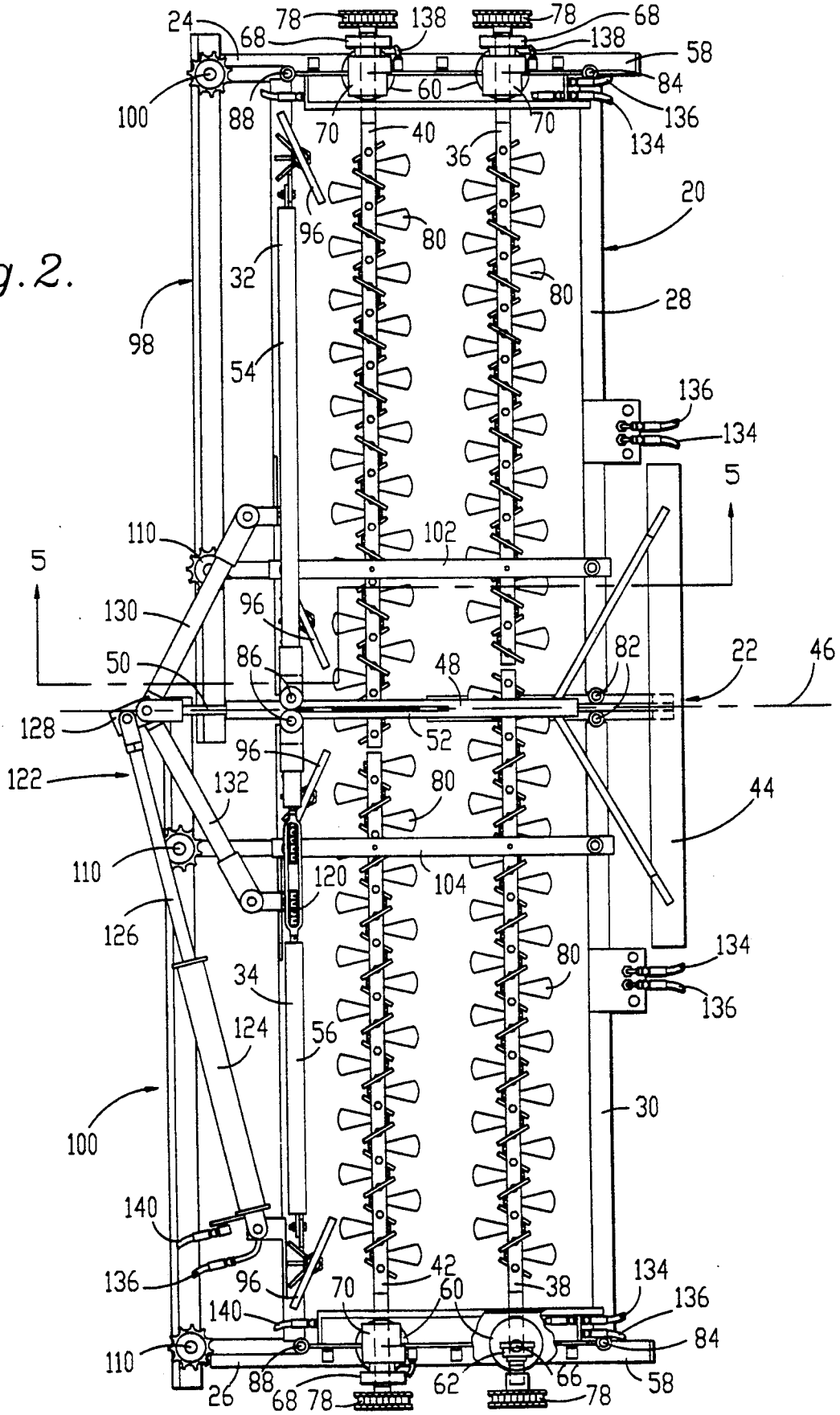
FIG. 2 is a top plan view of the spreader box apparatus, with the side walls illustrated in a fully extended position.

Turning to FIG. 2, the spreader box apparatus is illustrated as including a frame 22, a pair of side walls 24, 26, a pair of front walls 28, 30 each extending between the frame 22 and one of the side walls 24, 26, a pair of rear walls 32, 34 each extending between the frame and one of the side walls, and four spreader shafts 36, 38, 40, 42 extending inward from the sidewalls within the apparatus.

The frame 22 includes a hitch 44 or other means for permitting connection of the apparatus 20 to the pavement applicating machine 10, and defines a longitudinal central axis 46 extending in a direction parallel to the intended direction of travel of the apparatus. A cylinder 48 is secured to the frame and extends collinear with the longitudinal axis. This cylinder 48 receives a piston 50 that is movable relative to the cylinder for stabilizing a width adjustment operation described more fully below. The frame 22 also includes an upstanding fin 52 adapted to receive a pair of transverse braces 54, 56 extending between the frame and the rear walls 32, 34.

Figure 4:
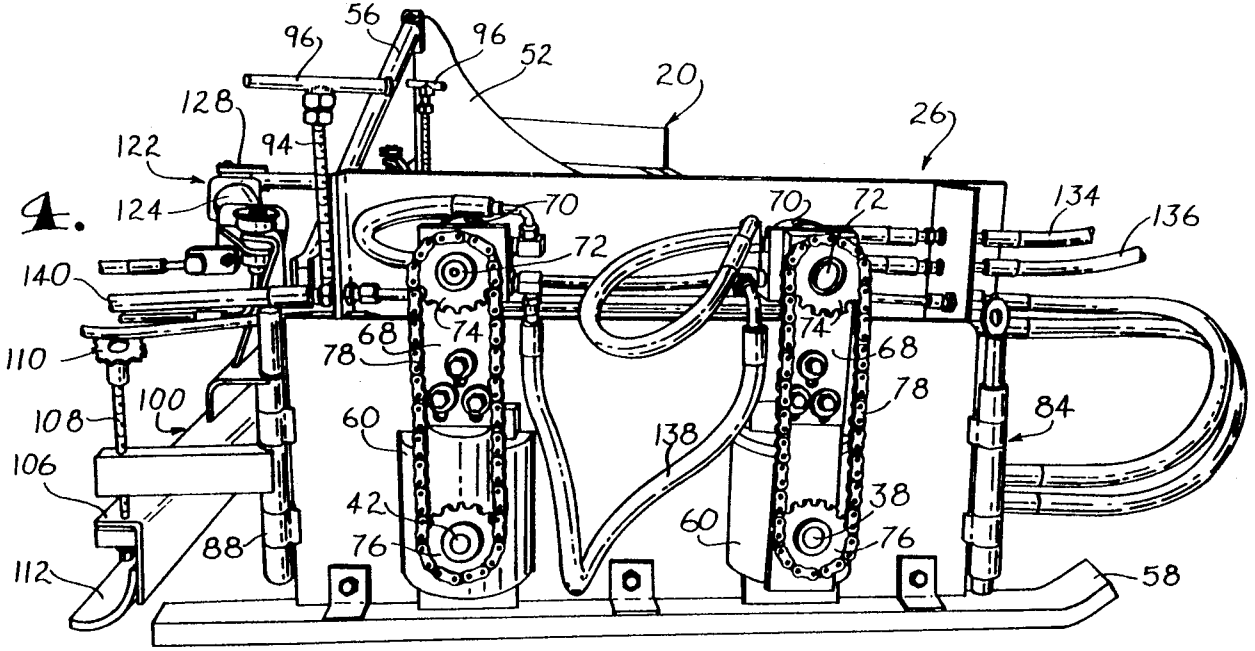
FIG. 4 is a perspective view of the spreader box apparatus.

One of the side walls 26 is shown in FIG. 4, and includes a skid 58 or other means for supporting the side wall on the surface to be paved for longitudinal movement relative to the surface during a paving operation. Two of the spreader shafts 38, 42 extend through and are supported on the side wall 26. As shown in FIG. 2, each of the shafts 36, 38, 40, 42 is supported for rotational movement within a cylindrical shaft housing 60 by a flange bearing 62 or the like secured within a suitable bearing mount 64. Each shaft housing 60 is provided with vertical shafts 66 extending from the upper and lower surfaces thereof and each shaft housing may be rotated about the vertical shafts relative to the side walls so that the shaft supported in each shaft housing may be pivoted relative to the side wall on which the shaft is supported.

Returning to FIG. 4, each shaft housing 60 is also provided with a mounting plate 68 extending vertically upward from the housing. A hydraulic motor 70 is secured to each mounting plate and includes a drive shaft 72 extending through the plate. Each drive shaft is connected to a sprocket 74 disposed adjacent the upper end of one of the mounting plates 68, and a similar sprocket 76 is connected to the end of each of the spreader shafts 36, 38, 40, 42 adjacent the lower end of each shaft housing. A chain 78 extends around the two sprockets associated with each shaft housing in order to deliver rotational driving force from each motor 70 to the spreader shaft associated therewith. Each of the shafts 36, 38, 40, 42 is provided with a large number of blades 80 secured thereto and extending radially outward in all directions from the shafts. During rotation of the shafts, the blades serve to move the pavement mixture within the apparatus between the side walls so as to distribute the mixture across the entire width of the region to be paved.

Because each mounting plate 68 is secured to one of the shaft housings 60, the plate, as well as the hydraulic motor 70, sprockets 74, 76, and chain 78 mounted on the plate, rotate with the shaft housing when the shaft housing moves relative to the side wall. Thus, when the side walls 24, 26 are moved between an extended position such as that shown in FIG. 2 toward a retracted position such as that shown in FIG. 3, the shafts 36, 38, 40, 42, and their respective drive motor assemblies pivot to accommodate the movement.

Returning to FIG. 2, the front walls 28, 30 are illustrated as extending between the frame 22 and the side walls 24, 26. Each front wall includes a first hinged connection 82 on the frame and a second hinged connection 84 on one of the side walls such that each front wall pivots relative to both the frame and the side wall to which it is connected if the side wall is moved relative to the frame.

Figure 5:
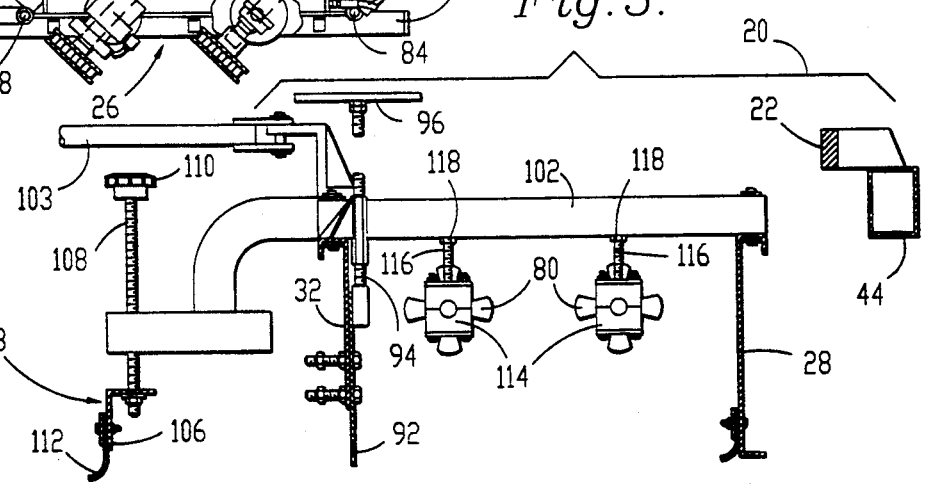
FIG. 5 is a side sectional view of the spreader box apparatus taken along line 5—5 of FIG. 2.

Similarly, each of the rear walls 32, 34 extend between the frame 22 and one of the side walls 24, 26, with each rear wall being provided with a first hinged connection 86 on the frame and a second hinged connection 88 on one of the side walls. As shown in FIG. 5, each front wall 28, 30 includes a wiper 90 secured thereto adjacent the lower edge of the wall. These wipers 90 prevent pavement mixture within the spreader box apparatus from pouring from the front of the apparatus during a paving operation. The rear walls 32, 34 each include a lower edge spaced above the surface to be paved so as to define a gap extending across the width of the apparatus. A screed 92 is positioned on each rear wall and extends downward into the gap in order to gauge the thickness of the pavement mixture being spread by the apparatus onto the surface. The screed 92 is movable in the vertical direction through the use of two threaded rods 94 which are affixed to the screed and extend through threaded orifices secured to each rear wall. A hand wheel 96 or the like is provided on each of the threaded rods 94 for permitting adjustment of the height of the screeds.

A pair of wiper assemblies 98, 100 are supported from the rear of the apparatus and extend inward from the side walls 24, 26. Each of the assemblies is mounted on one of the side walls and the assemblies are also supported from a pair of longitudinally extending support members 102, 104. Each wiper assembly 98, 100 includes a wiper plate 106 supported from one of the support members and from one of the side walls by threaded rods 108 that are adjustable to position the wiper plates at a desired height above the surface to be paved. Hand wheels 110 may be provided on the threaded rods to permit manual adjustment of the height of the wiper plates. A wiper 112 is secured to each of the wiper plates 106 and extends downward from the plate toward the surface. These wipers 112 serve to smooth the applied layer of pavement mixture after the mixture has been spread onto the surface by the apparatus. Preferably, one of the wiper assemblies is longer than the other and extends either to the front or rear of the other assembly so that the assemblies overlap regardless of the position of the side walls relative to the frame.

The longitudinally extending support members 102, 104 also support the spreader shafts extending across the apparatus beneath the members. A bearing block 114 is provided for each of the shafts 36, 38, 40, 42 and includes an upward extending threaded rod 116 that is received in a nut 118 or the like that is welded or otherwise fastened to the lower surface of the support member to which the bearing block is attached. During movement of the side walls 24, 26 relative to the frame 22, the shafts pivot beneath the support members causing the bearing blocks to rotate and turning the threaded rods 116 within the nuts 118. In this manner, the spreader shafts are supported relative to the frame and the horizontal swinging motion of the spreader shafts is accommodated. The support members 102, 104 are pivotally supported on the front and rear walls of the apparatus and remain substantially parallel to the central axis regardless of the position of the side walls.

Figure 3:
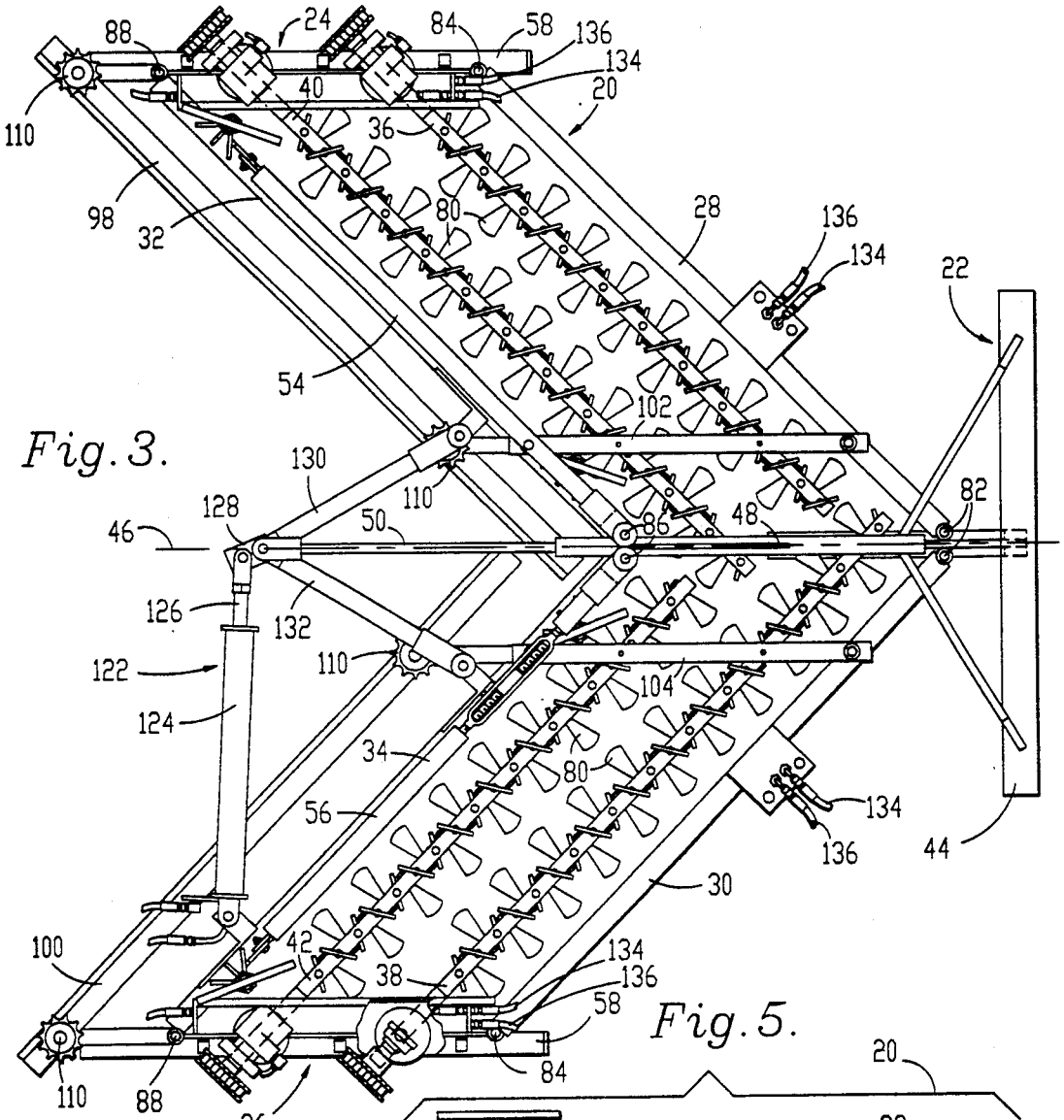
FIG. 3 is a top plan view of the spreader box apparatus, with the side walls illustrated in a retracted position.

Preferably, the spreader shafts are arranged in two rows, with each of the two shafts 36, 38 and 40, 42 in each row being substantially collinear with one another. However, because each shaft row includes two shafts, it is possible for the side walls to move to the retracted position, as shown in FIG. 3, and for the shafts to become reoriented to accommodate this movement. In one form of the invention, one of the shafts 38, 40 in each shaft row is longer than the other shaft 36, 42 so that when the side walls are moved between the extended and retracted positions, the two shafts in each row do not interfere with one another.

In order to provide rigidity to the apparatus, the braces 54, 56 are provided which extend from the fin 52 of the frame 22 laterally outward to a position on the rear walls 32, 34 just inboard of the side walls 24, 26. The braces extend downward from the fin and may be pivoted relative to the frame so that horizontal swinging movement of the side walls is accommodated. However, the braces are secured to the rear walls to prevent undesirable vertical bucking of the side walls during use of the apparatus. One of the braces 56 may be provided with a turnbuckle 120 to permit compensation to be made for differences in the lengths of the two braces.

Width adjustment driving means are provided on the apparatus, in the form of a cylinder and piston assembly 122, for moving the side walls horizontally along an arcuate path between the extended position shown in FIG. 2 and the retracted position shown in FIG. 3. The hydraulic cylinder and piston assembly is connected between one of the side walls 26 and the frame 22 by mounting the cylinder 124 on one of the rear walls 34 just inboard of the side wall 26, and by securing the remote end of the piston 126 to a linkage block 128 through which the piston cooperates with a pair of rigid links 130, 132.

One end of each of the links 130, 132 is mounted on one of the rear walls 32, 34 so that any movement imparted to the block 128 by the cylinder and piston assembly 122 is transmitted through the links 130, 132 to the rear walls 32, 34. The piston 50 associated with the cylinder 48 is also secured to the block 128 and serves to balance the motion transmitted to each of the links 130, 132 during operation of the cylinder and piston assembly 122. Thus, when the piston is retracted from the position shown in FIG. 2, the two links are pulled outward with equal force causing the rear walls, and thus the front walls and side walls as well, toward the retracted position shown in FIG. 3.

When this retracting movement is carried out, the total width of the apparatus is reduced from a maximum width of over twelve feet to a minimum width of approximately eight feet. Thus, it is possible to adjust the lateral dimension of the pavement mixture being spread on the surface in order to accommodate variations in the width of the surface.

Further, by permitting the side walls 24, 26 to be swung in either direction between the retracted and extended positions, it is possible to make changes in the width of the apparatus on the fly without shutting the machine 10 or the apparatus 20 down for extended periods of time. In this manner, time and effort are conserved and the paving operation may be carried out continuously over surfaces of varying widths.

The hydraulic power needed to operate the apparatus may be provided by a self-contained hydraulic system on the apparatus or by a system provided on the pavement applicating machine 10. Where the system of the machine is used, delivery and return lines 134, 136 are provided, as shown in FIG. 2, which extend between the hydraulic fluid source and the front hydraulic motor 70 of each side wall 24, 26. As shown in FIG. 4, an intermediate line 138 extends from the front motor to the rear motor and the rear motor is connected back through the return line to the fluid source. A parallel line 140 is provided on one of the side walls 26 and extends between the delivery line 134 adjacent the inlet of the front hydraulic motor and the hydraulic cylinder 124 of the cylinder and piston assembly 122. A return line 142 provided on the cylinder returns fluid to the fluid source. The motors 70 may be operated in either direction in order to rotate the spreader shafts in either direction. The cylinder may also be operated in either direction to permit the apparatus to be moved freely between the extended and retracted positions.

Although the invention has been described with reference to the illustrated preferred embodiment, it is understood that substitutions may be made and equivalents employed herein without departing from the scope of the invention as recited in the claims.

What is claimed is:

1. A spreader box apparatus for use with a pavement applicating machine in spreading a pavement mixture of predetermined lateral dimension and thickness onto a surface to be paved, the apparatus comprising:

a frame including means for permitting connection of the apparatus to the pavement applicating machine and defining a longitudinal central axis extending in a direction parallel to the intended direction of travel of the apparatus;

a pair of side walls connected to the frame and defining a dimension of width which corresponds to the predetermined lateral dimension of the pavement mixture to be spread by the apparatus;

spreading means for spreading the pavement mixture within the apparatus between the side walls;

means for supporting the side walls on the surface for longitudinal movement relative to the surface during a paving operation;

metering means for metering the thickness of the pavement mixture to be spread by the apparatus; and width adjustment means for permitting adjustment of the width of the apparatus by allowing movement of the side walls horizontally along separate symmetrical arcuate paths each extending between a first position in which each side wall is disposed at a maximum distance from the central axis and a second position in which each side wall is disposed at a minimum distance from the central axis, the variation in the width of the apparatus resulting in a corresponding change in the predetermined lateral dimension of the pavement mixture to be spread.

2. The spreader box apparatus as recited in claim 1, wherein the metering means includes at least one screed and means for adjusting and maintaining the height of the screed relative to the surface to be paved.

3. The spreader box apparatus as recited in claim 1, wherein the means for supporting the side walls on the surface includes a skid provided on each of the side walls.

4. The spreader box apparatus as recited in claim 1, further comprising a pair of front walls each connected between the frame and one of the side walls, the front wall being pivotally connected to the frame and to the side walls, so that movement of the side walls relative to the frame is permitted by pivoting the front walls relative to the frame.

5. The spreader box apparatus as recited in claim 4, further comprising a pair of rear walls each connected between the frame and one of the side walls, the rear walls being pivotally connected to the frame and to the side walls so that movement of the side walls relative to the frame is permitted by pivoting both the front and rear walls relative to the frame.

6. The spreader box apparatus as recited in claim 1, wherein the spreading means includes a pair of spreader shafts each of which is supported for rotation on one of the side walls and extends from the side wall toward the central longitudinal axis.

7. The spreader box apparatus as recited in claim 6, further including shaft housing means for supporting each shaft on one of the side walls and for permitting the shaft to be pivoted about a vertical axis relative to the side wall when the side wall is moved along the arcuate path.

8. The spreader box apparatus as recited in claim 7, further including drive means for carrying out rotation of each spreader shaft, the drive means including a motor mounted on each shaft housing for pivotal movement therewith relative to the side wall when the side wall is moved along the arcuate path.

9. The spreader box apparatus as recited in claim 1, further including adjustment driving means for moving the side walls along the arcuate path, the adjustment driving means including a hydraulic cylinder piston assembly connected between the side walls and the frame.

10. A spreader box apparatus for use with a pavement applicating machine in spreading a pavement mixture of predetermined lateral dimension and thickness onto a surface to be paved, the apparatus comprising:

a frame including means for permitting connection of the apparatus to the pavement applicating machine and defining a longitudinal central axis extending in a direction parallel to the intended direction of travel of the apparatus;

a pair of side walls connected to the frame and defining a dimension of width which corresponds to the predetermined lateral dimension of the pavement mixture to be spread by the apparatus;

spreading means for spreading the pavement mixture within the apparatus between the side walls;

means for supporting the side walls on the surface for longitudinal movement relative to the surface during a paving operation;

metering means for metering the thickness of the pavement mixture to be spread by the apparatus; and width adjustment means for permitting adjustment of the width of the apparatus by allowing movement of at least one of the side walls horizontally along an arcuate path extending between a first position in which the side wall is disposed at a maximum distance from the central axis and a second position in which the side wall is disposed at a minimum distance from the central axis, the variation in the width of the apparatus resulting in a corresponding change in the predetermined lateral dimension of the pavement mixture to be spread.

* * * * *